US005181189A

United States Patent [19]

Hafner

[11] Patent Number: 5,181,189

[45] Date of Patent: Jan. 19, 1993

[54] DEVICE FOR THE STORAGE AND TIME-REGULATED DISPENSING OF DRUGS

[76] Inventor: Dieter Hafner, D-8500 Nurnberg 30, Ostendstr. 132, Fed. Rep. of Germany

[21] Appl. No.: 125,298

[22] Filed: Nov. 25, 1987

[51] Int. Cl.[5] ..... G04B 47/00; B65D 83/04

[52] U.S. Cl. ..... 368/10; 206/534; 221/2

[58] Field of Search ..... 368/10, 28-30, 368/72-74, 250-251; 340/309.15, 309.4; 221/2, 3, 15; 364/413-415, 569; 235/375, 462-466, 472

[56] References Cited

U.S. PATENT DOCUMENTS 3,911,856 10/1975 Ewing ..... 116/121
3,968,900 7/1976 Stambuk ..... 221/3
4,258,354 3/1981 Carmon et al. ..... 340/309.4
4,504,153 3/1985 Schollmeyer ..... 368/10
4,526,474 7/1985 Simon ..... 368/10
4,725,997 2/1988 Urquhart et al. ..... 368/10
4,831,562 5/1989 McIntosh et al. ..... 364/569

FOREIGN PATENT DOCUMENTS 3518531 11/1988 Fed. Rep. of Germany .

*Primary Examiner*—Vit W. Miska
*Attorney, Agent, or Firm*—Morrison & Foerster

[57] ABSTRACT

A device for the storage and time-regulated dispensing of drugs includes a drug container to which is secured a signal generator that may be activated at preset intervals. In order to simplify the programming of the signal generator and make it usable for various drugs, the signal generator is provided with a reader for reading out information which relates to the drug in the drug container and which preferably is recorded on the drug container in code.

1 Claim, 1 Drawing Sheet

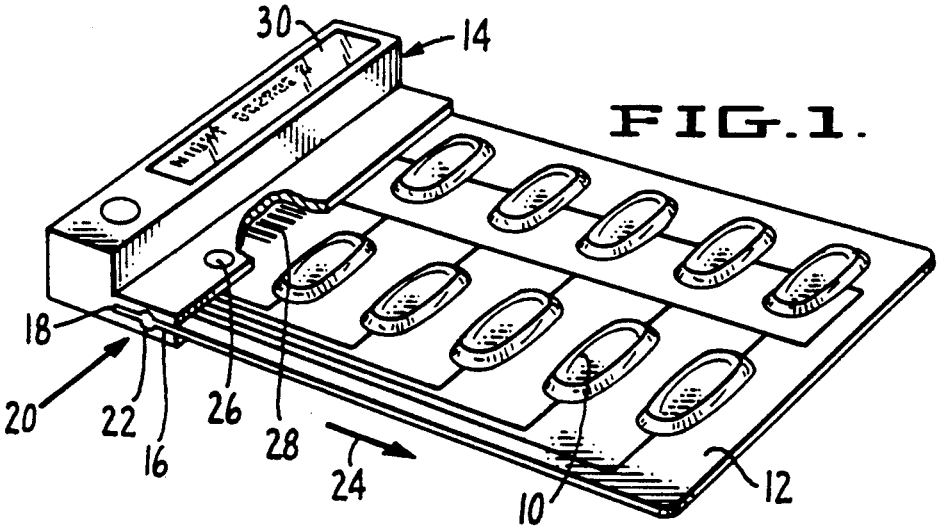
FIG. 1.
FIG. 2.
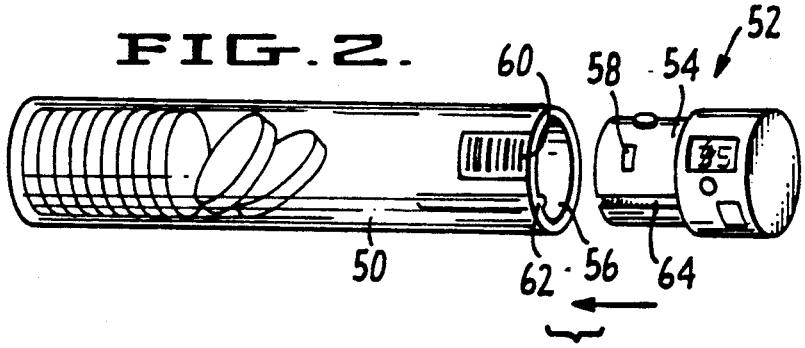
FIG. 3.
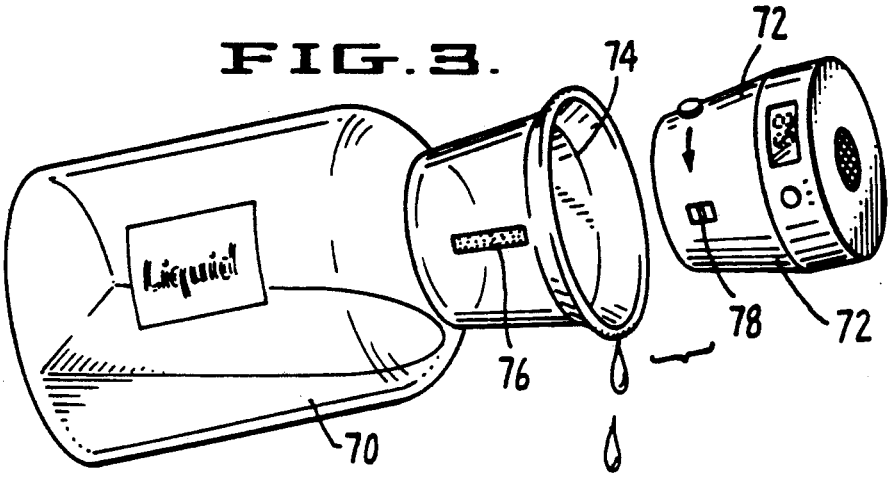

DEVICE FOR THE STORAGE AND TIME-REGULATED DISPENSING OF DRUGS

BACKGROUND OF THE INVENTION

This invention relates to a device for the storage and time-regulated dispensing of drugs to end users. More particularly, it relates to a device for storing drugs and emitting signals to the patient at preset intervals of time.

Description of Prior Art

German registration G 83 18 444.9 shows a drug container carrying a signal transmitter. The signal transmitter includes an electric clock and a signal tone generator and/or an optical signal display. The timer is set in motion manually or automatically by drawing a prescribed dose of the drug, and sounds a reminder to administer another dose following the expiration of a determined intake cycle.

When used properly, such a device makes it possible to increase the accuracy with which drugs are administered. This device is hard to operate. One has to set the time interval as a function of the drug being administered. Once this time interval has been rigidly preprogrammed into the signal transmitter (e.g., a 24 hour cycle for use with a contraceptive preparation), the device may not be employed in connection with other drugs Another disclosure of interest is West German patent 33 35 301 which teaches a drug storage means and a dose signaling device in which the start and cycle time may be inputted into the device by means of perforating conductor tracks which are situated on the drug container. In this device, the drug container is designed as a blister pack. This requires an additional step, however, and generally may not be done by untrained individuals.

It is an object of the present invention to further develop a device for the storage and time-regulated dispensing of drugs so as to make it easier to use and have it provide the user with information on various topics.

STATEMENT OF THE INVENTION

An improved device for the storage and time-regulated dispensing of drugs has now been found. This device includes a drug container such as a tablet tube, coated tablet container or drug bottle. The device also includes a signal transmitter which can be activated at preset intervals of time. The signal transmitter is either an integral component of the drug container or is detachably connected to it. In the device of this invention the signal transmitter is equipped with means for inputting information (for example, information concerning dosing regimen, intake cycle, side effects) related to the drug contained in the drug container. This information is encoded on a portion of the instructive package insert or other packaging accompanying the drug or is on the drug container itself. The information so inputted may be used, for example, to set, regulate, or alter the time intervals between dosing signals or it may be used to provide informational messages to the patient about the intolerances and side effects of the drug.

DETAILED DESCRIPTION OF THE INVENTION

Brief Description of the Drawings

This invention will be further described with reference being made to the accompanying drawing in which FIG. 1 is a perspective view of one embodiment of the present invention. In this embodiment the drugs are contained within individual blisters of a blister pack;

FIG. 2 illustrates in perspective view an embodiment of the invention in which the drug is contained in a tablet tube as a stack of tablets; and FIG. 3 illustrates in perspective view a third embodiment of the invention in which the drug is contained as a liquid in a bottle.

DESCRIPTION OF PREFERRED EMBODIMENTS

In accord with the present invention, a drug-containing dose-signaling device is equipped with means for inputting information such as a magnetic tape reader, a punched tape reader or a bar code reader. This makes it possible for a layman and in particular the patient himself, to simply and directly load the program which controls the signaling device. It is possible, for example, to incorporate a readable code pattern into the instructive leaflet or package insert accompanying the drug to be administered. This readable code can then be passed by the reader so as to input the information it contains needed for proper operation (e.g., dose cycle times, prescribed amounts to be administered, etc.) into the signaling device.

This improved device enables the user to load and store even complicated dosing routines with one move of the hand. For example, a dosing routine might require administration of an initial two pills three hours apart, followed by a gap of eight hours (overnight), followed by administration of single pills the next day on a three hour cycle, and so on. The code containing this information may also be located on the drug container itself and read in automatically when the signaling device and drug container are connected. In this embodiment, the data input device generally is best situated in that portion of the signaling device which lies adjacent to a section of the surface of the drug container containing the encoded information. For example, if the signaling device has a plug-in slit into which the side edge of a blister pack is inserted—(see above noted West German patent 33 35 301) it may be very suitable to mount the input reader in the slit into which the blister pack is inserted. The information on the blister pack thus can be read in completely automatically when the blister pack is inserted into the opening of the signaling device.

The data input device and the data with the drug can take various forms. These include, without limitation, providing the data as a bar code and using a bar code reader as the input device; presenting the data on a magnetic strip and employing a magnetic strip reader (scanning head); providing the data in the form of an edge code exhibiting projections on the drug container and employing an edge scanner as the data input device; employing the data as a punch card or tape code and using a punch-card or punch-tape reader as the input device; or employing the code as a conductor track and carrying out the data inputting by scanning and reading numerous scanning contacts. The information so inputted may be used by the signaling device to control or alter the pattern of signals it provides.

The signaling device may additionally be provided with an alphanumeric display. This display can completely or partially display the contents of a read-write memory into which the readout code information is written and stored so that the signaling device may be employed to impart very complex information to the patient. For example, the information read into the signaling device may include information about the intolerances or side effects of the drug. This information can be read out of memory by the word or line and shown on the alphanumeric display.

Turning to the figures, in FIG. 1, a device for the storage and time-regulated dispensing of drugs (10) in the form of coated tablets consists of a coated tablet container, more specifically a blister (12) and a signaling device (14) detachably connected to the blister (12). The connection between the blister (12) and the signaling device (14) is formed by a reception groove (16) into which one of the side edges (18) of the blister (12) is laterally inserted in the direction of arrow (20). In order to hold the side edge (18) of blister (12) securely in the reception groove (16), the blister (12) has been provided with a bulbous, thickened area (22) in the area of the side edge (18). This bulbous, thickened area (22) may be inserted into an appropriate recess in the reception groove (16). The connection between the signaling device (14) and blister (12) may therefore be carried out in the direction of arrow (24).

Signaling device (14) includes a reader (denoted by circle 26) positioned to read information which relates to the drug (10) in the blister (12) and recorded on the blister in code. In the embodiment shown, the information is present in the form of a bar code (28) printed in the area of the side edge (18) which is read by the reader (26) when the blister (12) is slid into signaling device (14) in direction (20). The information so read is placed in the memory of the signaling device (14). This memory is not shown in the figure. The reader (26) operates inside the reception groove (16). It is an optical- sensor which responds to black-and-white bar codes. Other representative alternatives to the bar code patterns depicted in FIG. 1 include card codes, codes recorded on magnetic strips with corresponding magnetic card reader, and edge codes, in which the side edge (18) of the blister may be furnished with a gradation containing a code.

As shown in FIG. 1 as well, the signaling device (14) is furnished with an alphanumeric indicator arrangement (30). The latter operates in a way known in the art with a drive circuit as well as internal memories. The code—bar code (28), for example—is broken down by the reader (26), stored in the memory, and as desired, shown on the display (30) in alphanumeric form.

Turning to FIG. 2 there is shown the drug container in the form of a tablet tube (50), with the signaling device (14) being incorporated into cap or inspection plug (52) whose bottom part may be introduced into the opening (56) of the tablet tube (50). Situated near the wall of the bottom part of cap 52 is a reader (58) with which a code (bar code 60) on the internal wall of the tablet tube may be read. This reading can occur, when the plug (52) is introduced into the tablet tube (50) for the first time. In order to ensure that the bar code (60) is properly aligned and scanned accurately by the reader (58), guiding means such as projection (62), and guiding groove (64) are provided on the tablet tube (50) and bottom part (54) respectively.

In the embodiment of the description shown in FIG. 3, the drug container is designed as a drug bottle (70) and the signaling device is incorporated in the cap or closure (72) for the bottle plug 72's tapering, cone shaped bottom part may be introduced into the opening (74) of the bottle to effect closure. Situated along the internal wall of the neck of the bottle is a magnetic strip (76) having a magnetically engraved code which may be scanned by a reader designed as a scanning head (78). Scanning takes place when the inspection plug (72) is introduced into the neck opening (74) of the bottle, after which the process of loading the program is completed. This scanning and loading is completed with the first insertion of the cap into the bottle. The scanning is repeated each time the cap is replaced, however, the signaling device can be programmed to disregard some or all of the information provided by the repetitive readings, if desired.

What is claimed is:

1. In a device for the storage and time-regulated dispensing of drugs consisting of a drug in a drug container in combination with means for providing a signal at preset intervals of time related to the regimen for dispensing the drug, the improvement comprising presenting the drug in a blister pack container, said blister pack container having information relating to the drug presented along an edge thereof, and incorporating in the means for providing a signal, means for receiving said edge of the blister pack and means for reading said information off of said edge of the blister pack when said blister pack is connected to the means for providing a signal by having its edge received therein.

* * * * *